US008405595B2

(12) United States Patent
Cho

(10) Patent No.: US 8,405,595 B2
(45) Date of Patent: Mar. 26, 2013

(54) DISPLAY DEVICE AND METHOD FOR CONTROLLING GATE PULSE MODULATION THEREOF

(75) Inventor: Namwook Cho, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 458 days.

(21) Appl. No.: 12/826,110

(22) Filed: Jun. 29, 2010

(65) Prior Publication Data

US 2011/0157123 A1 Jun. 30, 2011

(30) Foreign Application Priority Data

Dec. 24, 2009 (KR) ..... 10-2009-0131289

(51) Int. Cl.
*G09G 3/36* (2006.01)

(52) U.S. Cl. ..... 345/94; 345/100; 345/204

(58) Field of Classification Search ..... None
See application file for complete search history.

(56) References Cited

U.S. PATENT DOCUMENTS 7,106,291 B2 * 9/2006 Yoon ..... 345/98
8,164,556 B2 * 4/2012 Song et al. ..... 345/95

FOREIGN PATENT DOCUMENTS

JP 2004-15992 A 1/2004
JP 2008-9364 A 1/2008
JP 2009-2908 A 1/2009

* cited by examiner

*Primary Examiner* — Joseph Haley
(74) *Attorney, Agent, or Firm* — McKenna Long & Aldridge, LLP

(57) ABSTRACT

A display device comprises a display panel in which data lines and gate lines cross each other, a timing controller which outputs a single gate pulse modulation control signal ("FLK signal") and I-phase (where I is an integer equal to or more than 2) gate shift clocks which are sequentially delayed, an FLK dividing circuit which divides the single FLK signal to output J (where J is an integer equal to or more than 2 and smaller than I) FLK signals, a data driving circuit which converts digital video data into data voltages to supply the data voltages for the data lines, and a gate driving circuit which generates gate pulses by level-shifting voltages of the gate shift clocks, to modulate falling edge voltages of the gate pulses in response to the divided FLK signals, and to sequentially supply the modulated gate pulses for the gate lines.

19 Claims, 13 Drawing Sheets

DISPLAY DEVICE AND METHOD FOR CONTROLLING GATE PULSE MODULATION THEREOF

This application claims the benefit of Korea Patent Application No. 10-2009-0131289 filed on Dec. 24, 2009, the entire contents of which is incorporated herein by reference for all purposes as if fully set forth herein.

BACKGROUND

1. Field of Invention

This document relates to a display device and a method for controlling gate pulse modulation thereof.

2. Related Art

A liquid crystal display ("LCD") has been widely applied due to its lightweight, thin profile, lower power consumption driving, and so on. Such an LCD has been employed as a portable computer such as a notebook PC, an office automation device, an audio/video device, an indoor/outdoor advertisement display device or the like. The LCD displays images by controlling an electric field applied to LC cells to adjust a light from a backlight.

An active matrix type LCD comprises an display panel assembly provided with thin film transistors ("TFTs") which are disposed at the respective pixels and switch data voltages supplied for pixel electrodes, a data driving circuit which supplies the data voltages for data lines in the display panel assembly, a gate driving circuit which sequentially supplies gate pulses (or scan pulses) for gate lines in the display panel assembly, and a timing controller which controls operation timings of the above-described driving circuits.

In the active matrix type LCD, a voltage charged in the LC cell is influenced by a kickback voltage (or a feed through voltage) ΔVp generated due to a parasitic capacitance in the TFT. The kickback voltage ΔVp is given as the following equation (1).

$$\Delta Vp = \frac{Cgd}{Clc + Cst + Cgd}(VGH - VGL) \quad (1)$$

Where "Cgd" represents a parasitic capacitance generated between a gate terminal of the TFT connected to the gate line and a drain terminal of the TFT connected to a pixel electrode in the LC cell, and "VGH−VGL" represents a difference between a gate high voltage and a gate low voltage of the gate pulse supplied for the gate line.

The kickback voltage ΔVp may alter a voltage applied to the pixel electrode in the LC cell, thereby showing a flicker, an afterimage, a color deviation, or the like. As methods for reducing the kickback voltage ΔVp, there is a gate pulse modulation ("GPM") method for modulating the gate high voltage VGH at the falling edge of the gate pulse. FIG. 1 is a waveform diagram illustrating an example where a gate pulse is not modulated (NO GPM) and an example where a gate pulse is modulated (GPM). The gate high voltage VGH is lowered at the falling edge of the modulated gate pulse.

The timing controller generates a gate pulse modulation control signal (hereinafter, referred to as a "FLK signal") used to control modulation timings for the gate pulses along with gate shift clocks used to shift a gate start pulse GSP. Generally, the gate shift clocks are generated as clocks of two or more phases which are delayed sequentially, and the FLK signal is synchronized with each clock. A gate pulse modulation circuit in the gate driving circuit modulates the gate high voltage VGH in synchronization with the FLK signal.

As shown in FIG. 2, if an N-th (where N is a positive integer) gate pulse Nth GP and a (N+1)-th gate pulse (N+1)th GP overlap each other, the gate high voltage VGH is lowered not only at the edge of the gate pulse but also at a pulse-width duration where the gate high voltage VGH is required to be maintained. In FIG. 2, the reference numeral "VGHM" denotes a gate high voltage modulated in synchronization with the FLK signal. The modulation is performed at the duration where the gate high voltage VGH is required to be maintained, and this causes a current consumption to be increased and further a charging ratio of the data voltage in the display panel assembly to be reduced.

In order to solve this problem, there may be a consideration of a method where the FLK signal is divided into two or more phases and the gate pulse modulation circuits are configured independently from each other for each FLK signals. However, this method has problems in that the number of the FLK signals is increased to thereby add circuits in the timing controller and increase output pins of the timing controller, and the number of the FLK signals is increased as an overlap duration of the gate pulses are lengthened.

SUMMARY

Embodiments of the present invention provide a display device and a method for controlling a gate pulse modulation thereof capable of modulating gate pulses which overlap each other without changing a configuration of a timing controller.

According to an exemplary of the present invention, there is a display device comprising a display panel in which data lines and gate lines cross each other, a timing controller configured to output a single gate pulse modulation control signal ("FLK signal") and I-phase (where I is an integer equal to or more than 2) gate shift clocks which are sequentially delayed, an FLK dividing circuit configured to divide the single FLK signal to output J (where J is an integer equal to or more than 2 and smaller than I) FLK signals, a data driving circuit configured to convert digital video data into data voltages to supply the data voltages for the data lines, and a gate driving circuit configured to generate gate pulses by level-shifting voltages of the gate shift clocks, to modulate falling edge voltages of the gate pulses in response to the divided FLK signals, and to sequentially supply the modulated gate pulses for the gate lines.

The gate shift clocks may at least partially overlap each other. In this case, an N-th (where N is a positive integer) gate shift clock may overlap a latter part of a (N−1)-th gate shift clock by a predetermined time, and overlap a former part of a (N+1)-th gate shift clock by a predetermined time.

A frequency of the single FLK signal may be I times higher than a frequency of each of the gate shift clocks.

The gate shift clocks may include first to sixth gate shift clocks which are sequentially delayed. Here, the FLK dividing circuit may comprise a first FLK dividing circuit configured to perform AND operation for the single FLK signal, the N-th gate shift clock, and a (N+2) gate shift clock, thereby generating first to sixth FLK signals, and a second FLK dividing circuit configured to perform OR operation for the first FLK signal and the fourth FLK signal to generate a I-th FLK signal, perform OR operation for the second FLK signal and the fifth FLK signal to generate a II-th FLK signal, and perform the third FLK signal and the sixth FLK signal to generate a III-th FLK signal.

The first to sixth FLK signals may have the same phase difference as the gate shift clocks, and substantially have the same frequency as the gate shift clocks. Here, a frequency of each of the I-th to III-th FLK signals may be twice higher than a frequency of each of the first to sixth FLK signals.

The gate driving circuit may comprise a first gate pulse modulation circuit configured to output a first gate pulse in response to the I-th FLK signal and the first gate shift clock, and reduce a voltage of the first gate pulse to a predetermined gate modulation high voltage between a falling edge of the I-th FLK signal and a falling edge of the first gate shift clock, a second gate pulse modulation circuit configured to output a second gate pulse in response to the II-th FLK signal and the second gate shift clock, and reduce a voltage of the second gate pulse to the gate modulation high voltage between a falling edge of the II-th FLK signal and a falling edge of the second gate shift clock, a third gate pulse modulation circuit configured to output a third gate pulse in response to the III-th FLK signal and the third gate shift clock, and reduce a voltage of the third gate pulse to the gate modulation high voltage between a falling edge of the III-th FLK signal and a falling edge of the third gate shift clock, a fourth gate pulse modulation circuit configured to output a fourth gate pulse in response to the I-th FLK signal and the fourth gate shift clock, and reduce a voltage of the fourth gate pulse to the gate modulation high voltage between a falling edge of the I-th FLK signal and a falling edge of the fourth gate shift clock, a fifth gate pulse modulation circuit configured to output a fifth gate pulse in response to the II-th FLK signal and the fifth gate shift clock, and reduce a voltage of the fifth gate pulse to the gate modulation high voltage between a falling edge of the II-th FLK signal and a falling edge of the fifth gate shift clock, and a sixth gate pulse modulation circuit configured to output a sixth gate pulse in response to the III-th FLK signal and the sixth gate shift clock, and reduce a voltage of the sixth gate pulse to the gate modulation high voltage between a falling edge of the III-th FLK signal and a falling edge of the sixth gate shift clock. Here, the gate pulses may be all varied between a gate high voltage and a gate low voltage and are sequentially delayed with the same phase difference as the gate shift clocks, and the gate modulation high voltage may be higher than the gate low voltage and lower than the gate high voltage.

The gate shift clocks may includes first to fourth gate shift clocks which are sequentially delayed. Here, the FLK dividing circuit may comprise a first FLK dividing circuit configured to perform AND operation for the single FLK signal, the N-th gate shift clock, and the (N+1) gate shift clock, thereby generating first to fourth FLK signals, and a second FLK dividing circuit configured to perform OR operation for the first FLK signal and the third FLK signal to generate a I-th FLK signal, and perform OR operation for the second FLK signal and the fourth FLK signal to generate a II-th FLK signal.

The first to fourth FLK signals may have the same phase difference as the gate shift clocks, and substantially have the same frequency as the gate shift clocks. Here, a frequency of each of the I-th and II-th FLK signals may be twice higher than a frequency of each of the first to fourth FLK signals.

The gate driving circuit may comprise a first gate pulse modulation circuit configured to output a first gate pulse in response to the I-th FLK signal and the first gate shift clock, and reduce a voltage of the first gate pulse to a predetermined gate modulation high voltage between a falling edge of the I-th FLK signal and a falling edge of the first gate shift clock, a second gate pulse modulation circuit configured to output a second gate pulse in response to the II-th FLK signal and the second gate shift clock, and reduce a voltage of the second gate pulse to the gate modulation high voltage between a falling edge of the II-th FLK signal and a falling edge of the second gate shift clock, a third gate pulse modulation circuit configured to output a third gate pulse in response to the III-th FLK signal and the third gate shift clock, and reduce a voltage of the third gate pulse to the gate modulation high voltage between a falling edge of the III-th FLK signal and a falling edge of the third gate shift clock, and a fourth gate pulse modulation circuit configured to output a fourth gate pulse in response to the II-th FLK signal and the fourth gate shift clock, and reduce a voltage of the fourth gate pulse to the gate modulation high voltage between a falling edge of the II-th FLK signal and a falling edge of the fourth gate shift clock. Here, the gate pulses may be all varied between a gate high voltage and a gate low voltage and are sequentially delayed with the same phase difference as the gate shift clocks, and the gate modulation high voltage may be higher than the gate low voltage and lower than the gate high voltage.

The display device may be any one of a liquid crystal display (LCD), an organic light emitting diode (OLED) display, and an electrophoresis display (EPD).

According to an embodiment of the present invention, there is a method for controlling a gate pulse modulation, the method comprising dividing a single FLK signal to output J (where J is an integer equal to or more than 2 and smaller than I) FLK signals, and generating gate pulses by level-shifting voltages of gate shift clocks, modulating falling edge voltages of the gate pulses in response to divided FLK signals, and sequentially supplying the modulated gate pulses for gate lines.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION

Figure 1:
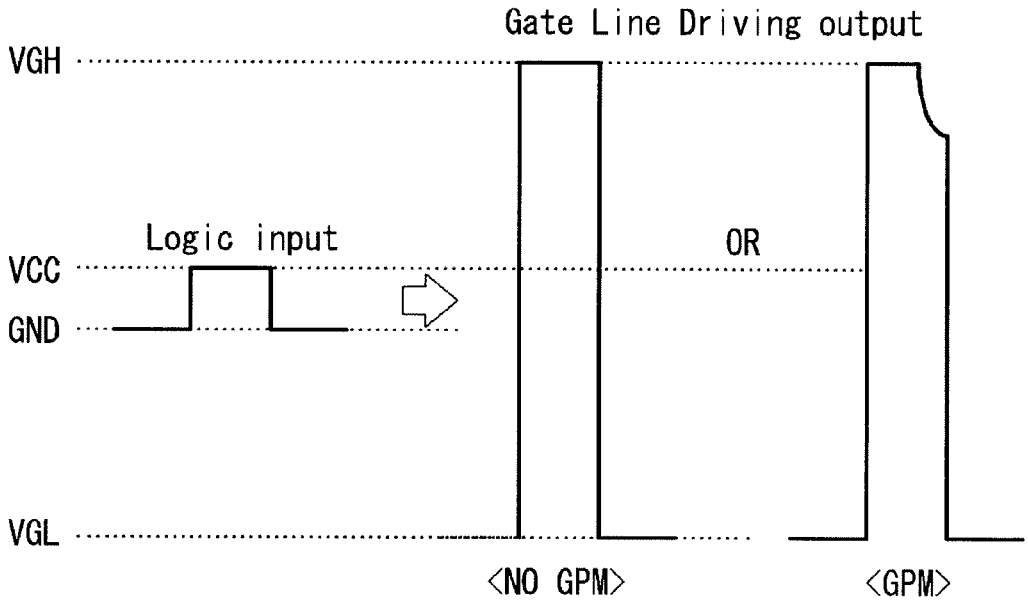
FIG. 1 (RELATED ART)
FIG. 1 is a waveform diagram of a level shift of a gate pulse and modulation of a gate high voltage.
Figure 2:
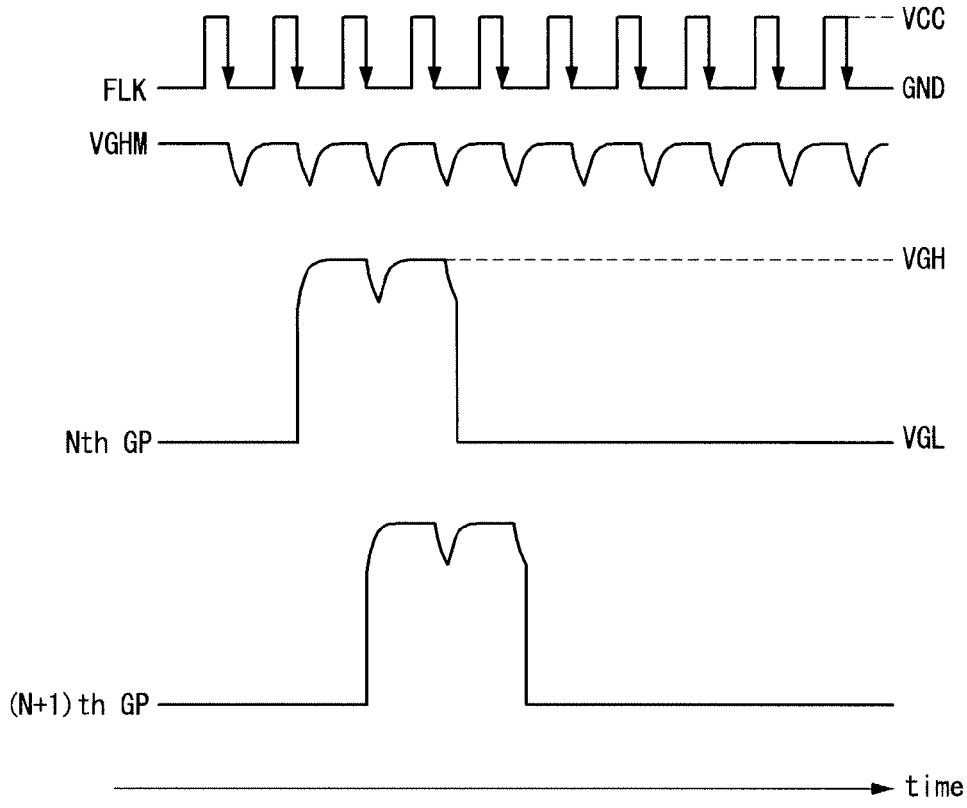
FIG. 2 (RELATED ART)
FIG. 2 is a waveform diagram illustrating an example of modulating a gate pulse by the use of a single FLK signal in an overlap driving of gate pulses.

The display device according to this document may include any other display device which sequentially supplies gate pluses (or scan pulses) for gate lines to write video data in pixels in a line sequential scanning method. For example, the display device may include, but not limited to, a liquid crystal display (LCD), an organic light emitting diode (OLED) display, an electrophoresis display (EPD), or the like.

The LCD according to this document may be implemented, when classified by LC modes, by a TN (twisted nematic) mode, a VA (vertical alignment) mode, an IPS (in plane switching) mode, an FFS (fringe field switching) mode, or the liked. In addition, when classified by a transmittance-to-voltage characteristic, the LCD according to this document may be implemented by a normally white mode or a normally black mode. The LCD according to this document may be implemented by any other type, for example, such as a transmissive LCD, a transflective LCD, a reflective LCD, or the like.

With reference to the accompanying drawings, exemplary embodiments of this document will be described by exemplifying an LCD. It is noted that the description of the following embodiments is made principally based on an LCD, but this document is not limited to the LCD. Like reference numerals designate like elements throughout the specification. In the following explanations, when a detailed description of well-known functions or configurations related to this document is determined to unnecessarily cloud a gist of this document, the detailed description thereof will be omitted.

Names of the respective elements used in the following explanations are selected for convenience of writing the specification and may be thus different from those in actual products.

Figure 3:
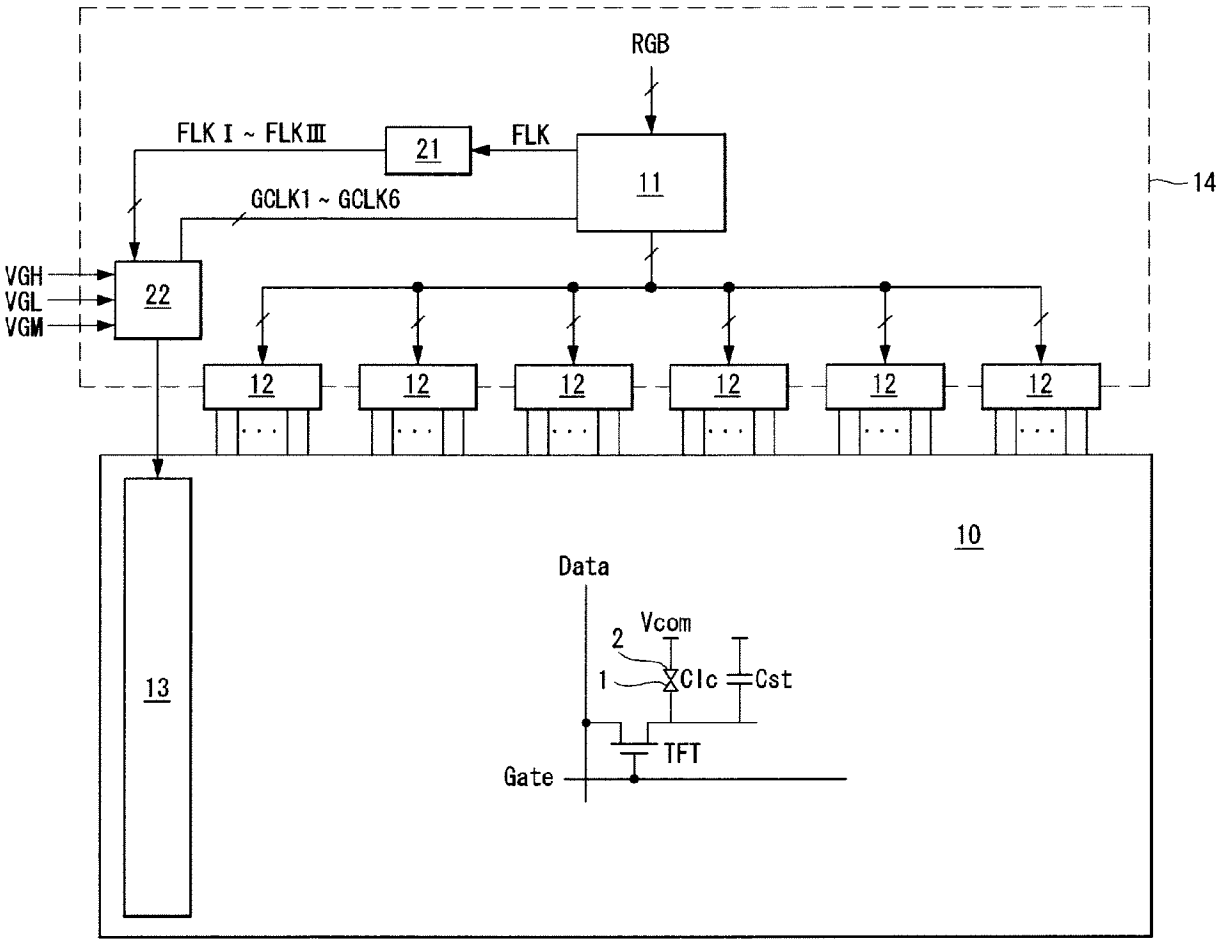
FIG. 3 is a block diagram illustrating a display device according to an embodiment of this document.

Referring to FIG. 3, a display device according to an embodiment of this document comprises a display panel assembly 10, a data driving circuit, an FLK dividing circuit 21, a gate driving circuit, and a timing controller 11, and so on.

The display panel assembly 10 has an LC layer interposed between two panels. A lower panel of the display panel assembly 10 is a TFT array panel which includes data lines, gate lines intersecting the data lines, TFTs disposed at the respective intersections of the data lines and the gate lines, LC cells connected to the TFTs and driven by electric field generated between pixel electrodes 1 and common electrodes 2, and storage capacitors. An upper panel of the display panel assembly 10 is a color filter array panel which includes black matrices and color filters. The common electrodes 2 are disposed on the upper panel in a vertical field driving type such as a TN mode and a VA mode, and are disposed on the lower panel along with the pixel electrodes in a horizontal field driving type such as an IPS mode and an FFS mode. Polarizers of which optical axes are orthogonal to each other are respectively attached to the outer surfaces of the lower and upper panels of the display panel assembly 10. In addition, alignment layers are formed on the inner surfaces having contact to the LC layer to set pretilt angles of the LC layer.

The display panel assembly 10 may be implemented by any one display panel assembly of an organic light emitting diode (OLED) display and an electrophoresis display (EPD), not limited to the LCD.

The data driving circuit comprises a plurality of source drive ICs 12. The source drive ICs 12 receives digital video data RGB from the timing controller 11. The source drive ICs 12 convert the digital video data RGB into positive/negative analog data voltages, in response to source timing control signals from the timing controller 11, and supplies the data voltages for the data lines in the display panel assembly 10 in synchronization with the gate pulses. The source drive ICs 12 may be connected to the data lines in the display panel assembly 10 by a COG (chip on glass) process or a TAB (tape automated bonding) process. FIG. 3 shows an example where the source drive ICs are mounted on tape carrier packages (TCPs), and joined to a printed circuit board (PCB) 14 and the lower panel of the display panel assembly 10 by the TAB scheme.

The FLK dividing circuit 21 is connected between the timing controller 11 and the gate driving circuit. The FLK dividing circuit 21 may be mounted on the PCB 14. The FLK dividing circuit 21 divides a single FLK signal output from the timing controller 11 to generate a number of FLK signals FLK I to FLK III, and provides the FLK signals FLK I to FLK III to the gate driving circuit.

The gate driving circuit comprises a level shifter 22 and a shift register 13 connected between the timing controller 11 and the gate lines in the display panel assembly 10.

The level shifter 22 level-shifts a TTL (transistor transistor logic) level voltage of gate shift clocks CLK output from the timing controller 11, to have the gate high voltage VGH and the gate low voltage VGL. The gate shift clocks GCLK1 to GCLK6 are input to the level shifter 22 as I-phase (where I is a positive integer equal to or more than 2) clocks having a predetermined phase difference. In FIG. 3, six-phase clocks are shown as an example of the gate shift clocks GCLK1 to GCLK6.

The level shifter 22 modulates the gate high voltage VGH to have a lower level at the falling edges of the gate shift clocks which have been level-shifted, in response to the FLK signals FLK I to FLK III output from the FLK dividing circuit 21. Thereby, the kickback voltage $\Delta Vp$ is reduced. The shift register 13 shifts the clocks output from the level shifter 22 to sequentially supply the gate pulses for the gate lines in the display panel assembly 10.

The gate driving circuit may be directly formed on the lower panel of the display panel assembly 10 by a GIP (gate in panel) scheme, or may be connected between the scan lines in the display panel assembly 10 and the timing controller 11 by the TAB scheme. By the GIP scheme, the level shifter 22 may be mounted on the PCB 14, and the shift register 13 may be formed on the lower panel of the display panel assembly 10. By the TAB scheme, the level shifter and the shift register may be integrated into one chip, mounted on the TCPs, and attached to the lower panel of the display panel assembly 10. The FLK dividing circuit 21 may be embedded in the level shifter 22.

The timing controller 11 receives the digital video data RGB from an external device via an interface such as an LVDS (low voltage differential signaling) interface, a TMDS (transition minimized differential signaling) interface or the like. The timing controller 11 transmits the digital video data from the external device to the source drive ICs 12.

The timing controller 11 receives timing signals such as a vertical synchronizing signal Vsync, a horizontal synchronizing signal Hsync, a data enable signal DE, a main clock MCLK, and so forth, from the external device via an LVDS or TMDS interface reception circuit. The timing controller 11 generates timing control signals for controlling operation timings of the data driving circuit and the gate driving circuit with respect to the timing signals from the external device. The timing control signals include gate timing control signals for controlling operation timings of the gate driving circuit, and data timing signals for controlling operation timings of the source drive ICs 12 and polarities of the data voltages.

The gate timing control signals include a gate start pulse GSP, the gate shift clocks CLK, the single FLK signal, a gate output enable signal GOE (not shown), and so forth. The gate start pulse GSP is input to the shift register 22 to control shift start timings. The gate shift clocks CLK are input to the level shifter 22 and level-shifted, which are then input to the shift register 13, and are used as clock signals for shifting the gate start pulse GSP. The single FLK signal FLK is generated as clocks synchronized with each clock of the gate shift clocks CLK and controls modulation timings of the gate pulses. The gate output enable signal GOE controls output timings of the shift register 13.

The data timing control signals include a source start pulse SSP, a source sampling clock SSC, a polarity control signal POL, a source output enable signal SOE, and so on. The source start pulse SSP controls shift start timings in the source drive ICs 12. The source sampling clock SSC is a clock signal which controls data sampling timings with respect to a rising edge or a falling edge in the source drive ICs 12. The polarity control signal POL controls polarities of the data voltages output from the source drive ICs 12. If a data transmission interface between the timing controller 11 and the source drive ICs 12 is a mini LVDS interface, the source start pulse SSP and the source sampling clock SSC may be omitted.

Figure 4:
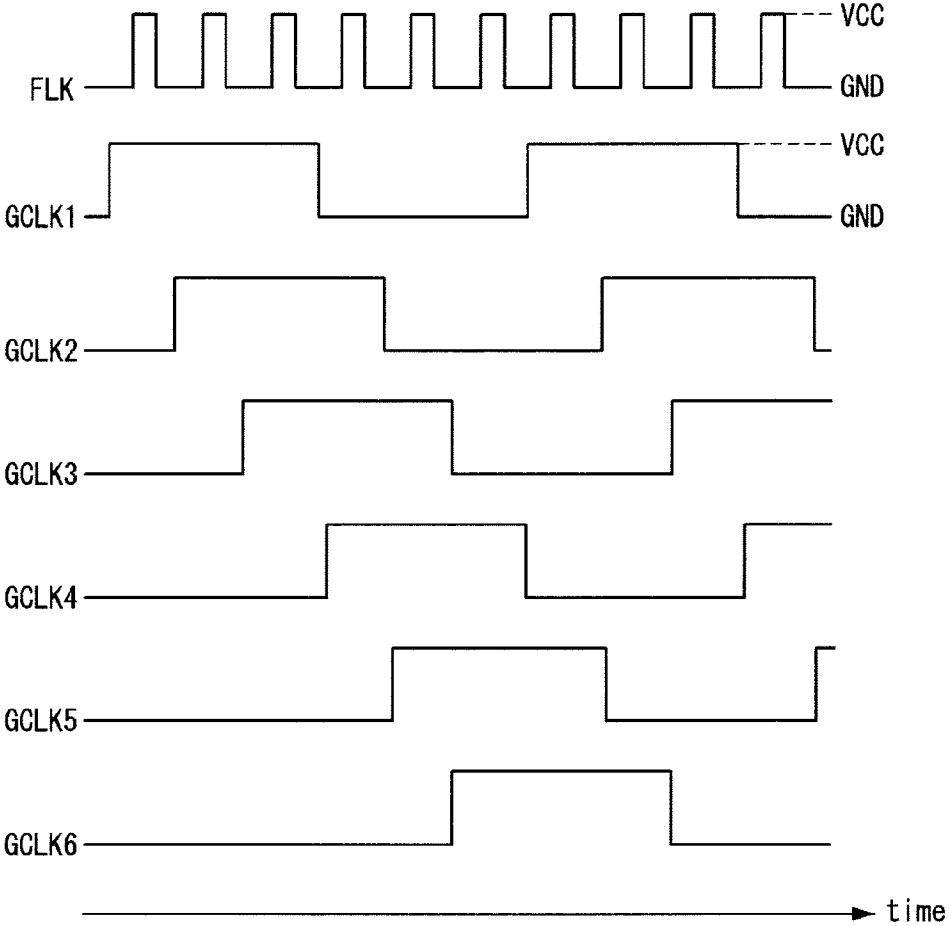
FIG. 4 is a waveform diagram illustrating a single FLK signal and six-phase gate shift clocks output from the timing controller shown in FIG. 3.

FIG. 4 is a waveform diagram illustrating a single FLK signal FLK and six-phase gate shift clocks output from the timing controller 11.

Referring to FIG. 4, the timing controller 11 outputs the six-phase gate shift clocks GCLK1 to GCLK6 which are sequentially delayed in phases and the single FLK signal FLK with higher frequency than each of the six-phase gate shift clocks GCLK1 to GCLK6. The gate shift clocks GCLK1 to GCLK6 and the single FLK signal FLK are varied between the ground voltage (0V) GND and a logic power supply voltage (3.3V) Vcc.

In the gate shift clocks GCLK1 to GCLK6, an N-th (where N is an integer circulated ranging from one to six in FIG. 4) gate shift clock partially overlaps a latter part of a (N−1)-th gate shift clock by a predetermined time and partially overlaps a former part of a (N+1)-th gate shift clock by a predetermined time. For example, the sixth gate shift clock GCLK6 partially overlaps a latter part of the fifth gate shift clock GCLK5 and partially overlaps a former part of the first gate shift clock GCLK1.

The clocks of the single FLK signal FLK are synchronized with the respective the gate shift clocks GCLK1 to GCLK6. Therefore, the frequency of the FLK signal FLK is about six times higher than that of each of the gate shift clocks GCLK1 to GCLK6.

Figure 5:
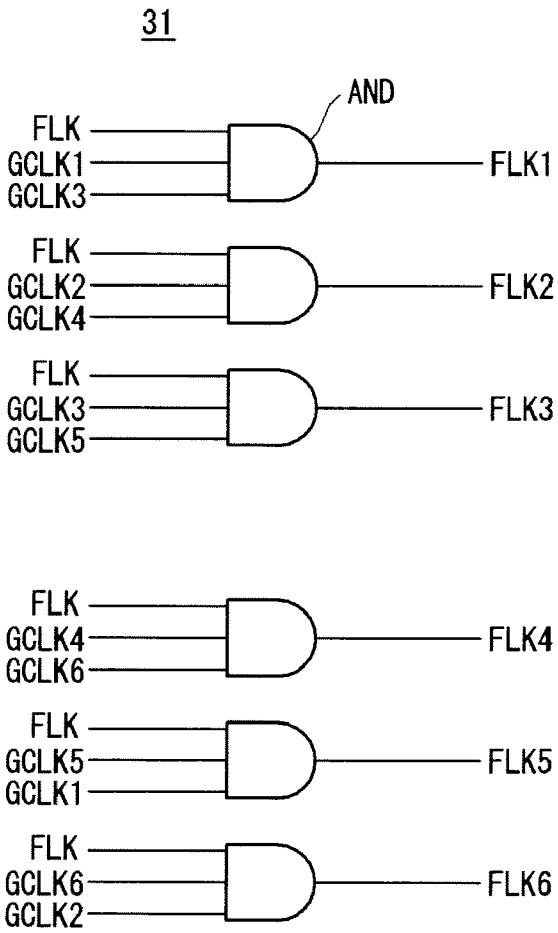
FIG. 5 is a block diagram illustrating a first embodiment of the FLK diving circuit shown in FIG. 3.

FIG. 5 is a block diagram illustrating the FLK dividing circuit 21.

Referring to FIG. 5, the FLK dividing circuit 21 comprises a first FLK dividing circuit 31 and a second FLK dividing circuit 32.

Figure 6:
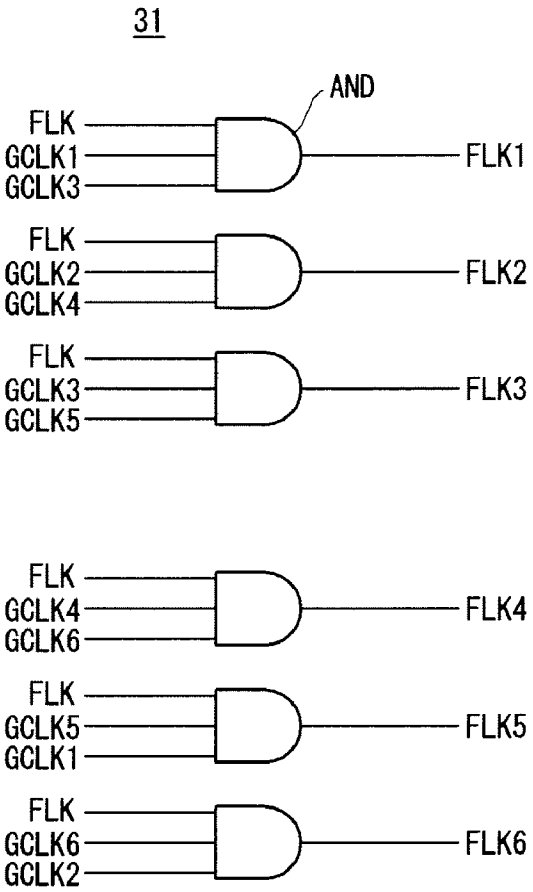
FIG. 6 is a detailed circuit diagram illustrating the first FLK dividing circuit shown in FIG. 5.

The first FLK dividing circuit 31 performs logical product ("AND") operation for the single FLK signal FLK, the N-th gate shift clock, and the (N+2)-th gate shift clock by the use of the AND gates as shown in FIG. 6, thereby generating first to sixth FLK signals FLK1 to FLK6. The first to sixth FLK signals FLK1 to FLK6 have the same phase difference as the gate shift clocks GCLK1 to GCLK6, and have the same frequency as the gate shift clocks GCLK1 to GCLK6. That is to say, a phase difference between two adjacent FLK signals is the same as that between two adjacent gate shift clocks.

Figure 7:
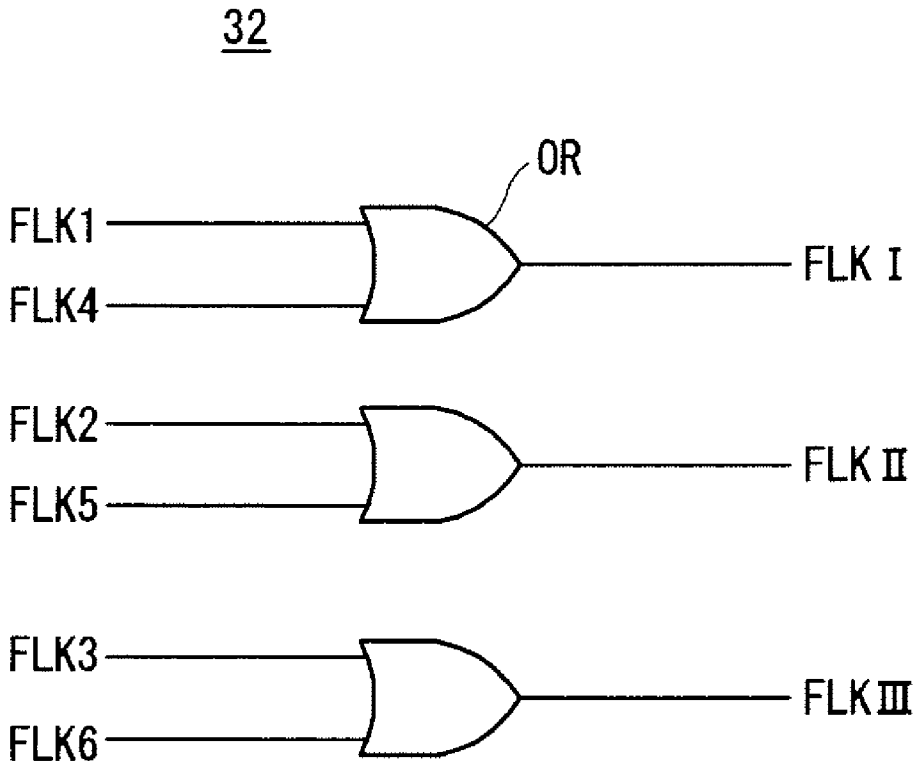
FIG. 7 is a detailed circuit diagram illustrating the second FLK circuit shown in FIG. 5.

The second FLK dividing circuit 32 performs logical sum ("OR") operation for the first FLK signal FLK1 and the fourth FLK signal FLK4 by the use of the OR gates as shown in FIG. 7, thereby generating the I-th FLK signal FLK I, and performs OR operation for the second FLK signal FLK2 and the fifth FLK signal FLK5, thereby generating the II-th FLK signal FLK II. In addition, the second FLK dividing circuit 32 performs OR operation for the third FLK signal FLK3 and the sixth signal FLK6 to generate the III-th FLK signal FLK III. The frequency of each of the I-th to III-th FLK signals FLK I to FLK III is twice higher than that of each of the first to sixth FLK signals FLK1 to FLK6.

Figure 8:
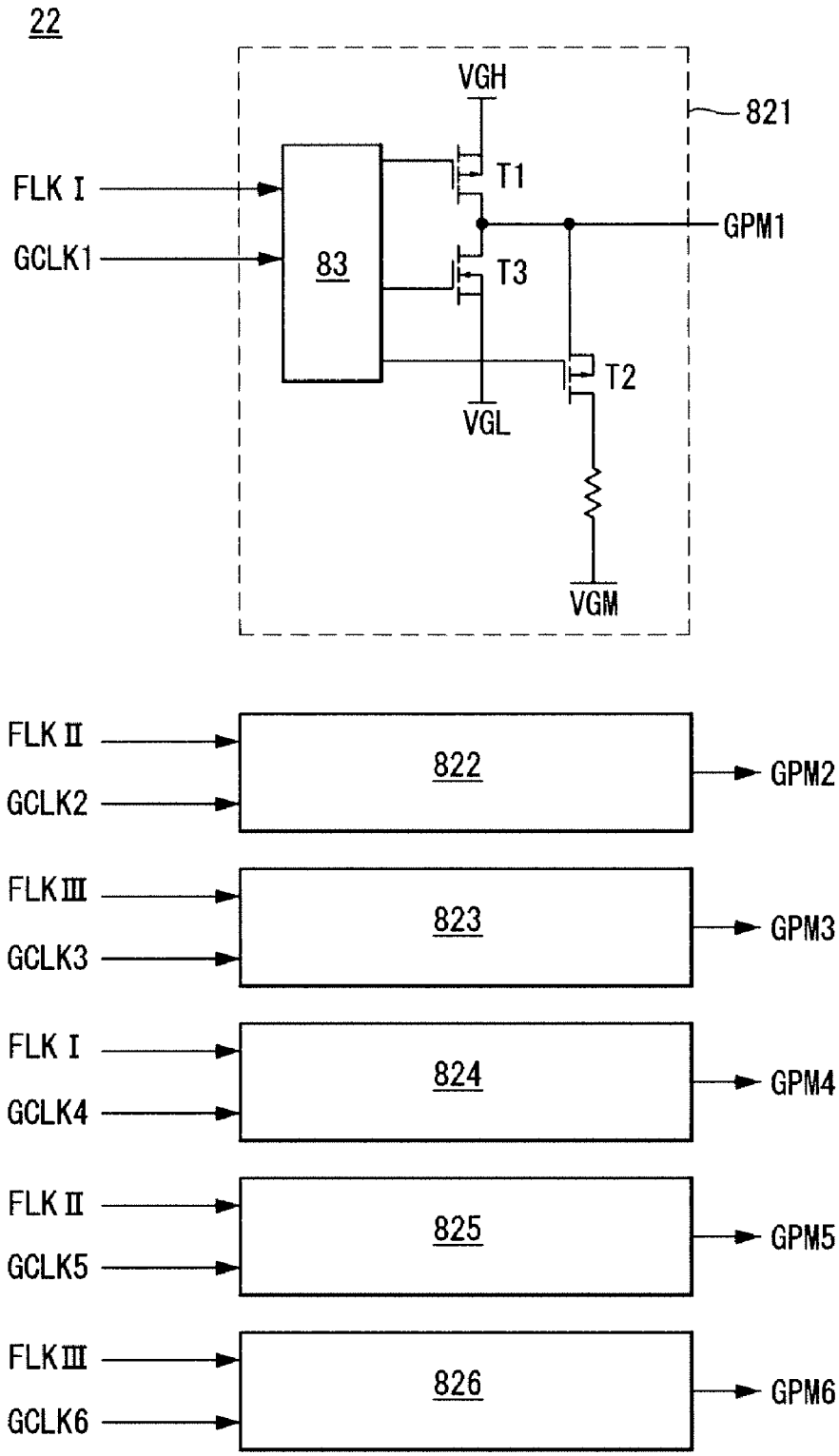
FIG. 8 is a detailed circuit diagram illustrating a first embodiment of the level shifter shown in FIG. 3.
Figure 9:
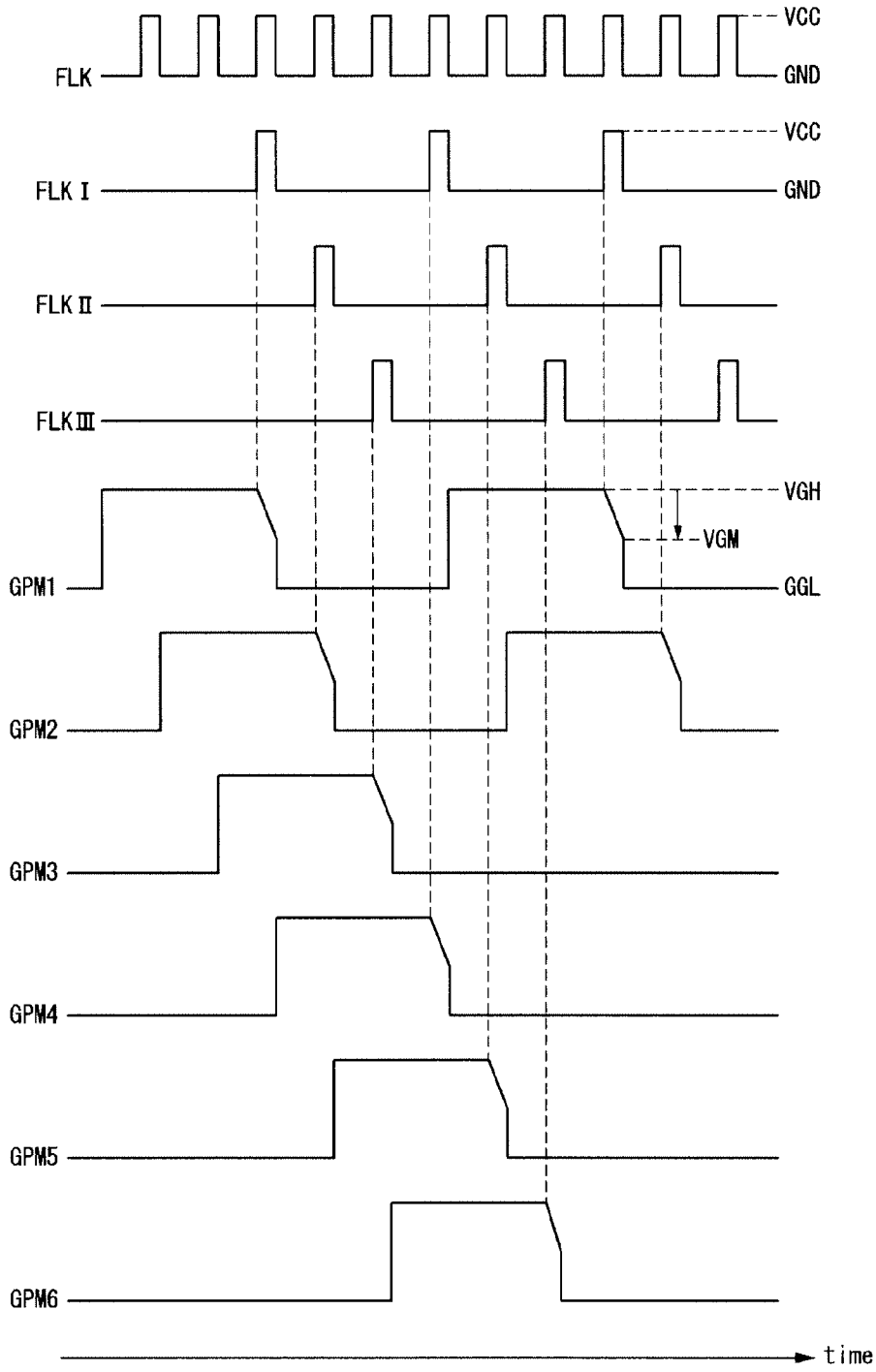
FIG. 9 is a waveform diagram illustrating FLK signals divided by the FLK dividing circuit shown in FIG. 5 and outputs of the level shifter shown in FIG. 8.

FIG. 8 is a detailed circuit diagram illustrating the level shifter 22. FIG. 9 is a waveform diagram illustrating the FLK signals FLK I to FLK III divided by the FLK dividing circuit 21 and outputs of the level shifter 22.

In FIGS. 8 and 9, the level shifter 22 comprises first to sixth gate pulse modulation circuits 821 to 826.

Each of the gate pulse modulation circuits 821 to 826 is applied with any one of the FLK signals FLK I to FLK III and any one of the gate shift clocks GCLK1 to GCLK6. In addition, each of the gate pulse modulation circuits 821 to 826 is supplied with the gate high voltage VGH, a gate modulation high voltage VGM, and the gate low voltage VGL. The gate high voltage VGH is set to a voltage equal to or more than the threshold voltages of the TFTs formed on the TFT array panel of the display panel assembly 10, and has about 20V. The gate low voltage VGL is set to a voltage equal to or less than the threshold voltages of the TFTs formed on the TFT array panel of the display panel assembly 10, and has about −5V. The gate modulation high modulation VGM is lower than the gate high voltage VGH and higher than the gate low voltage VGL.

The first gate pulse modulation circuit 821 outputs a first gate pulse GPM1 in response to the I-th FLK signal FLK I and the first gate shift clock GCLK1. The second gate pulse modulation circuit 822 outputs a second gate pulse GPM2 in response to the II-th FLK signal FLK II and the second gate shift clock GCLK2. The third gate pulse modulation circuit 823 outputs a third gate pulse GPM3 in response to the III-th FLK signal FLK III and the third gate shift clock GCLK3. The fourth gate pulse modulation circuit 824 outputs a fourth gate pulse GPM4 in response to the I-th FLK signal FLK I and the fourth gate shift clock GCLK4. The fifth gate pulse modulation circuit 825 outputs a fifth gate pulse GPM5 in response to the II-th FLK signal FLK II and the fifth gate shift clock GCLK5. The sixth gate pulse modulation circuit 826 outputs a sixth gate pulse GPM6 in response to the III-th FLK signal FLK III and the sixth gate shift clock GCLK6. The gate pulses GPM1 to GPM6 all vary between the gate high voltage VGH and the gate low voltage VGL and sequentially delayed with the same phase difference as the gate shift clocks GCLK1 to GCLK6. The falling edge voltages of the gate pulses GPM1 to GPM6 are reduced to the gate modulation high voltage VGM from the gate high voltage VGH in synchronization with the FLK signals FLK I to FLK III, and then is reduced to the gate low voltage VGL from the gate modulation high voltage VGM. The gate pulses GPM1 to GPM6 are supplied for the gate lines in the display panel assembly 10 via the shift register 13.

The respective gate pulse modulation circuits 821 to 826 comprise logic units 83, and first to third transistors T1 to T3.

The first and second transistors T1 and T2 are implemented by an n type MOS (metal oxide semiconductor) TFT and the third transistors T3 are implemented by a p type MOS TFT.

The logic units 83 control turn-on/turn-off operation timings of the transistors T1 to T3 in response to any one of the FLK signals FLK I to FLK III and any one of the gate shift clocks GCLK1 to GCLK6. The logic units 83 output first switch control signals for controlling the first transistors T1 via first output terminals. The logic units 83 output second switch control signals for controlling the second transistors T2 via second output terminals. The logic units 83 output third switch control signals for controlling the third transistors T3 via third output terminals.

The first transistors T1 are turned on in synchronization with the rising edges of the gate shift clocks GCLK1 to GCLK6 under the control of the logic units 83, transmit the gate high voltage VGH to the output terminals of the gate pulse modulation circuits 821 to 826, and are turned off in synchronization with the falling edges of the FLK signals FLK I to FLK III. Gate terminals of the first transistors T1 are connected to the output terminals of the logic units 83, and drain terminals of the first transistors T1 are connected to the output terminals of the gate pulse modulation circuits 821 to 826. Source terminals of the first transistors T1 are applied with the gate high voltage VGH.

The second transistors T2 are turned on in synchronization with the falling edges of the FLK signals FLK I to FLK III under the control of the logic units 83, transmit the gate modulation high voltage VGM to the output terminals of the gate pulse modulation circuits 821 to 826, and are turned off in synchronization with the falling edges of the FLK signals gate shift clocks GCLK1 to GCLK6. Gate terminals of the second transistors T2 are connected to the output terminals of the logic units 83, and source terminals of the second transistors T2 are connected to the output terminals of the gate pulse modulation circuits 821 to 826. Drain terminals of the second transistors T2 are applied with the gate modulation high voltage VGM.

The third transistors T3 are turned on in synchronization with the falling edges of the gate shift clocks GCLK1 to GCLK6 under the control of the logic units 83, transmit the gate low voltage VGL to the output terminals of the gate pulse modulation circuits 821 to 826, and are turned off in synchronization with the rising edges of the gate shift clocks GCLK1 to GCLK6. Gate terminals of the third transistors T3 are connected to the output terminals of the logic units 83, and drain terminals of the third transistors T3 are connected to the output terminals of the gate pulse modulation circuits 821 to 826. Source terminals of the third transistors T3 is applied with the gate low voltage VGL.

The timing controller 11 may generate four-phase gate shift clocks GCLK1 to GCLK4. FIGS. 10 to 15 are diagrams illustrating a gate pulse modulation method for the four-phase gate shift clocks GCLK1 to GCLK4.

Figure 10:
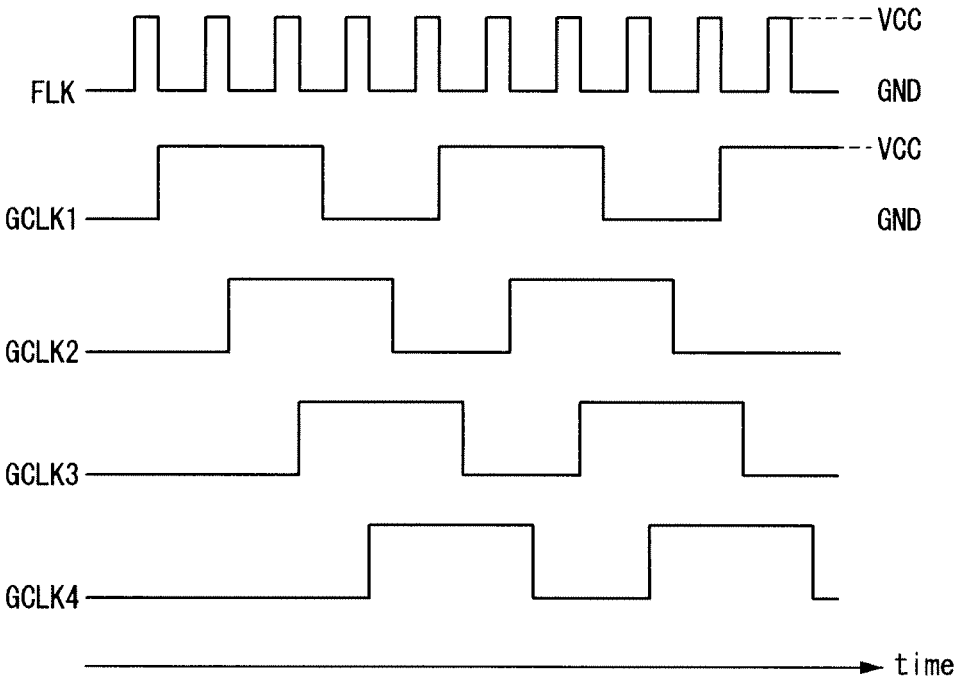
FIG. 10 is a waveform diagram illustrating a single FLK signal and four-phase gate shift clocks output from the timing controller shown in FIG. 3.

FIG. 10 is a waveform diagram illustrating a single FLK signal FLK and the four-phase gate shift clocks GCLK1 to GCLK4 output from the timing controller 11.

Referring FIG. 10, the timing controller 11 outputs the four-phase gate shift clocks GCLK1 to GCLK4 which are sequentially delayed in phase and a single FLK signal FLK with a higher frequency than each of the gate shift clocks GCLK1 to GCLK4. The gate shift clocks GCLK1 to GCLK4 and the single FLK signal FLK are varied between the ground voltage (0V) GND and the logic power supply voltage (3.3V) Vcc.

In the gate shift clocks GCLK1 to GCLK4, an N-th (where N is an integer circulated ranging from one to four in FIG. 10) gate shift clock partially overlaps a latter part of a (N−1)-th gate shift clock and partially overlaps a former part of a (N+1)-th gate shift clock by a predetermined time. For example, the fourth gate shift clock GCLK4 partially overlaps a latter part of the third gate shift clock GCLK3 and partially overlaps a former part of the first gate shift clock GCLK1.

The clocks of the single FLK signal FLK are synchronized with the respective the gate shift clocks GCLK1 to GCLK4. Therefore, the frequency of the FLK signal FLK is about four times higher than that of each of the gate shift clocks GCLK1 to GCLK4.

In the meantime, the gate shift clocks according to an embodiment of this document are not limited to the six-phase gate shift clocks described above or the four-phase gate shift clocks described later. For example, the timing controller 11 may output the single FLK signal FLK and I-phase (where I is an integer equal to or more than 2) gate shift clocks which are sequentially delayed. The FLK dividing circuit 21 may divide the single FLK signal FLK to output J (where J is an integer equal to or more than 2 and smaller than I) FLK signals.

Figure 11:
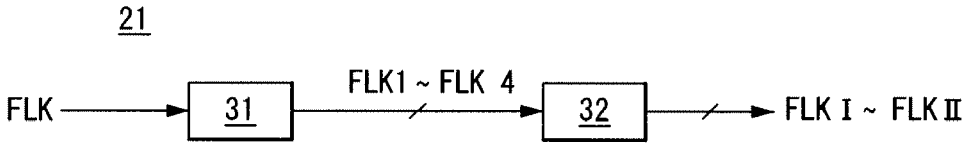
FIG. 11 is a block diagram illustrating a second embodiment of the FLK dividing circuit shown in FIG. 3.

FIG. 11 is a block diagram illustrating the FLK dividing circuit 21 which is shown in FIG. 10 and divides the single FLK signal FLK.

In FIG. 11, the FLK dividing circuit 21 comprises a first FLK dividing circuit 31 and a second FLK dividing circuit 32.

Figure 12:
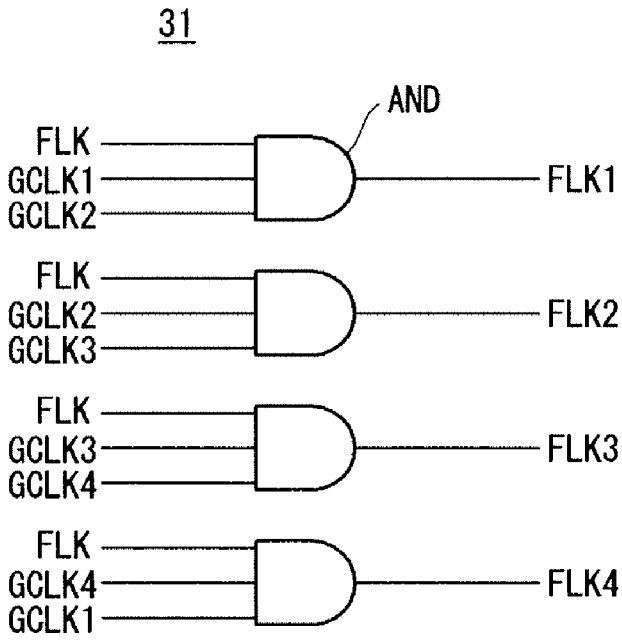
FIG. 12 is a detailed circuit diagram illustrating the first FLK dividing circuit shown in FIG. 11.

The first FLK dividing circuit 31 performs AND operation for the single FLK signal FLK, the N-th gate shift clock, and the (N+1)-th gate shift clock by the use of the AND gates as shown in FIG. 12, thereby generating first to fourth FLK signals FLK1 to FLK4. The first to fourth FLK signals FLK1 to FLK4 have the same phase difference as the gate shift clocks GCLK1 to GCLK4, and have the same frequency as the gate shift clocks GCLK1 to GCLK4. That is to say, a phase difference between two adjacent FLK signals is the same as that between two adjacent gate shift clocks.

Figure 13:
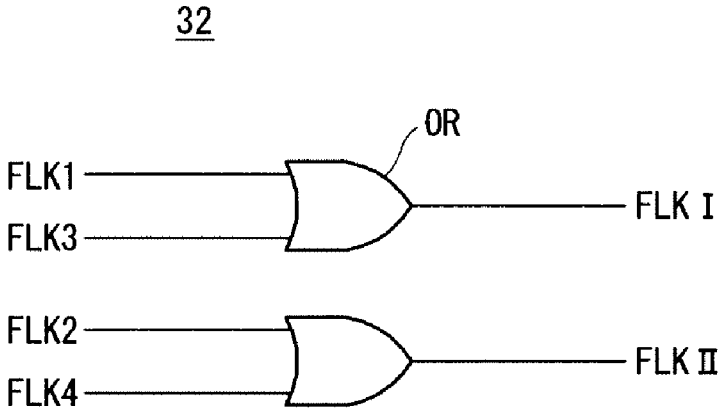
FIG. 13 is a detailed circuit diagram illustrating the second FLK dividing circuit shown in FIG. 11.

The second FLK dividing circuit 32 performs OR operation for the first FLK signal FLK1 and the third FLK signal FLK3 by the use of the OR gates as shown in FIG. 13, thereby generating the I-th FLK signal FLK I, and performs OR operation for the second FLK signal FLK2 and the fourth FLK signal FLK4, thereby generating the II-th FLK signal FLK II. The frequency of each of the I-th and II-th FLK signals FLK I and FLK II is twice higher than that of each of the first to fourth FLK signals FLK I to FLK4.

Figure 14:
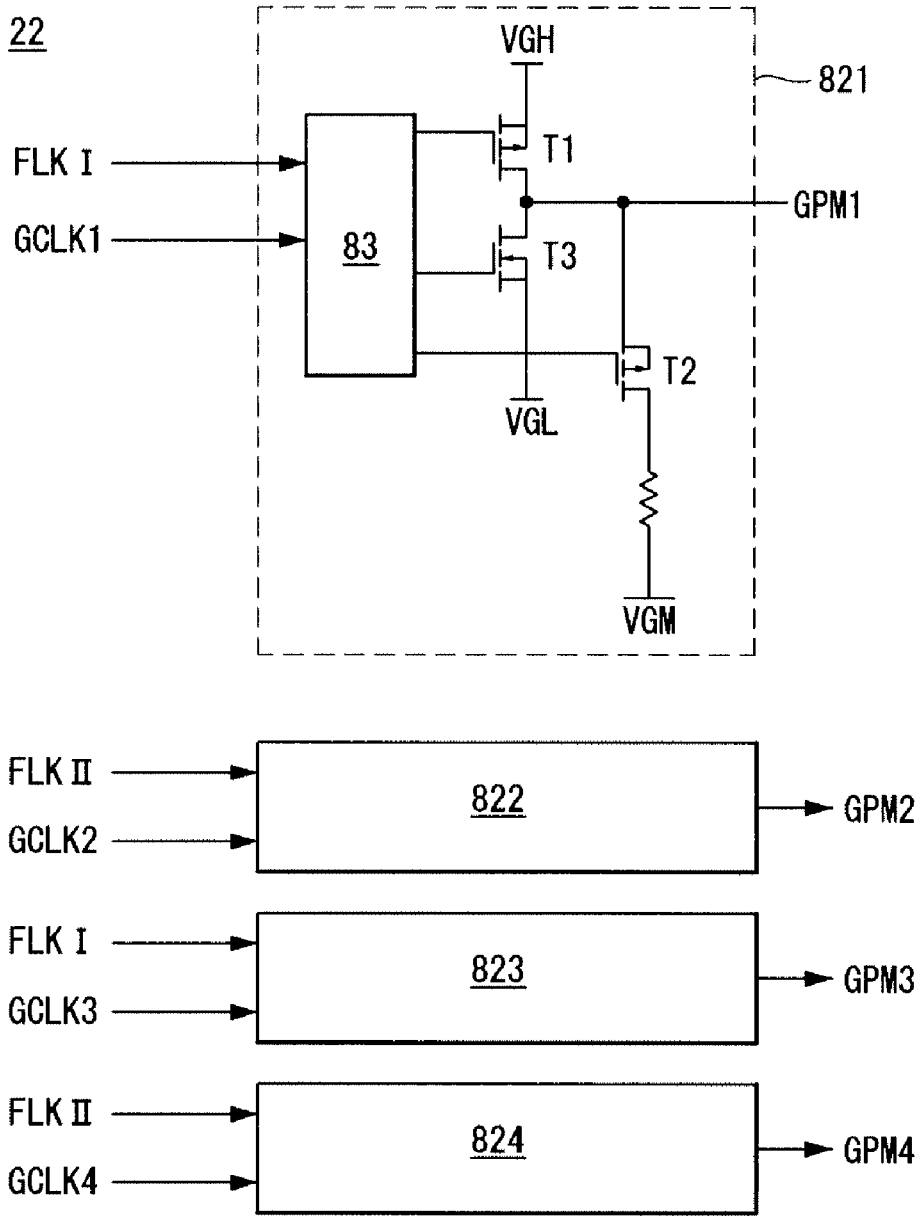
FIG. 14 is a detailed circuit diagram illustrating a second embodiment of the level shifter shown in FIG. 3.
Figure 15:
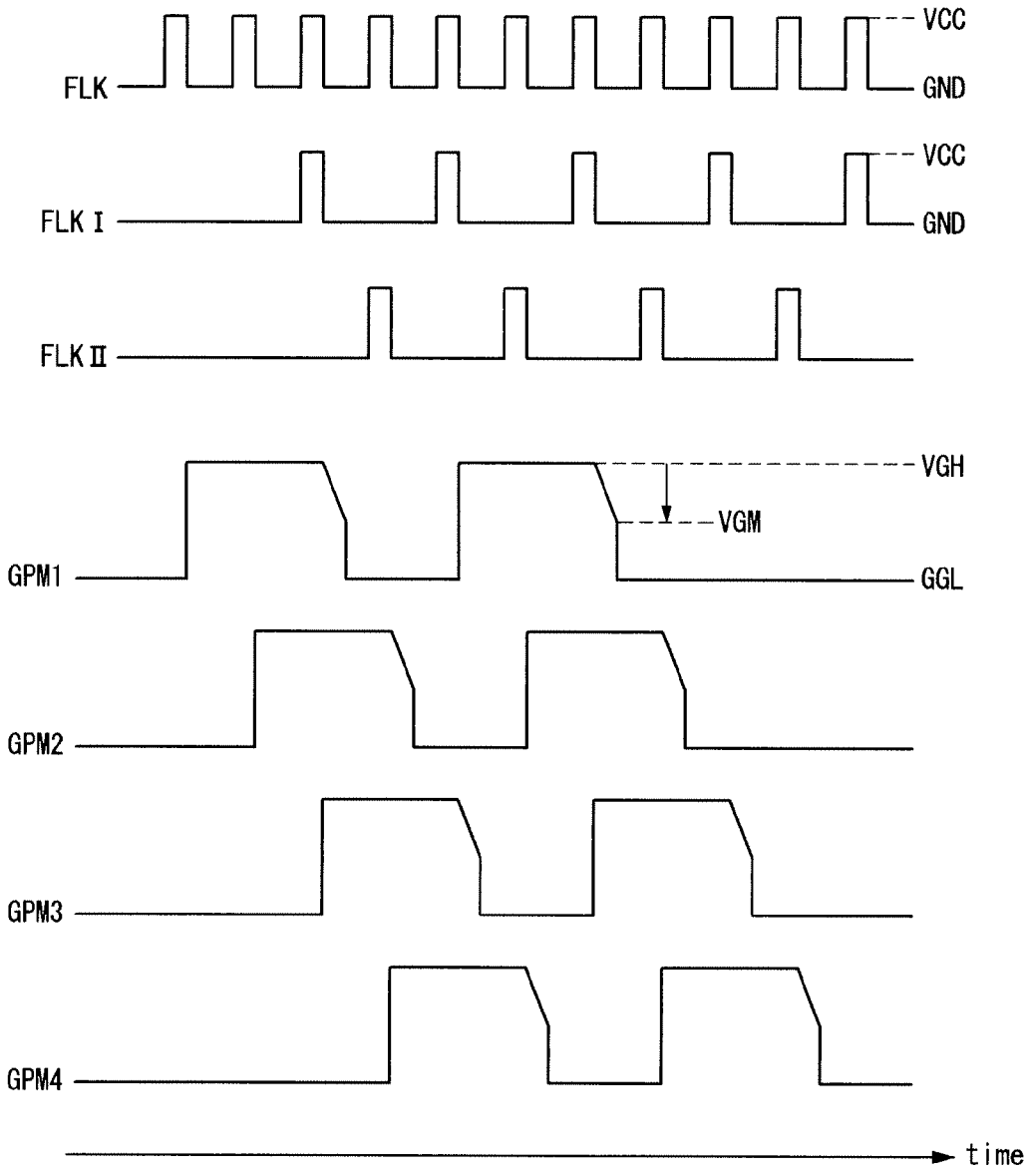
FIG. 15 is a waveform diagram illustrating FLK signals divided by the FLK dividing circuit shown in FIG. 11 and outputs of the level shifter shown in FIG. 14.

FIG. 14 is a detailed circuit diagram illustrating the level shifter 22 which level-shifts the four-phase gate shift clocks GCLK1 to GCLK4 shown in FIG. 10. FIG. 15 is a waveform diagram illustrating the FLK signals FLK I and FLK II divided by the FLK dividing circuit 21 shown in FIG. 11 and outputs of the level shifter 22 shown in FIG. 14.

In FIGS. 14 and 15, the level shifter 22 comprises first to fourth gate pulse modulation circuits 821 to 824.

Each of the gate pulse modulation circuits 821 to 824 is applied with any one of the FLK signals FLK I and FLK II and any one of the gate shift clocks GCLK1 to GCLK4. In addition, each of the gate pulse modulation circuits 821 to 824 is supplied with the gate high voltage VGH, a gate modulation high voltage VGM, and the gate low voltage VGL.

The first gate pulse modulation circuit 821 outputs a first gate pulse GPM1 in response to the I-th FLK signal FLK I and the first gate shift clock GCLK1. The second gate pulse modulation circuit 822 outputs a second gate pulse GPM2 in response to the II-th FLK signal FLK II and the second gate shift clock GCLK2. The third gate pulse modulation circuit 823 outputs a third gate pulse GPM3 in response to the I-th FLK signal FLK I and the third gate shift clock GCLK3. The fourth gate pulse modulation circuit 824 outputs a fourth gate pulse GPM4 in response to the II-th FLK signal FLK II and the fourth gate shift clock GCLK4. Each of the gate pulses GPM1 to GPM4 is varied between the gate high voltage VGH and the gate low voltage VGL and sequentially delayed with the same phase difference as the gate shift clocks GCLK1 to GCLK4. The falling edge voltages of the gate pulses GPM1 to GPM4 are reduced to the gate modulation high voltage VGM from the gate high voltage VGH in synchronization with the FLK signals FLK I and FLK II, and then are reduced to the gate low voltage VGL from the gate modulation high voltage VGM. The gate pulses GPM1 to GPM4 are supplied for the gate lines in the display panel assembly 10 via the shift register 13.

Each of the gate pulse modulation circuits 821 to 824 comprises a logic unit 83, and first to third transistors T1 to T3. The first and second transistors T1 and T2 are implemented by an n type MOS TFT and the third transistor T3 is implemented by a p type MOS TFT.

As described above, according to the embodiments of this document, it is possible to divide the single FLK signal output from the timing controller and modulate the falling edge voltages of the gate pulses by the use of the divided FLK signals, thereby modulating the gate pulses which overlap each other without changing the configuration of the timing controller.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display panel in which data lines and gate lines cross each other;

a timing controller configured to output a single gate pulse modulation control signal ("FLK signal") and I-phase (where I is an integer equal to or more than 2) gate shift clocks which are sequentially delayed;

an FLK dividing circuit configured to divide the single FLK signal to output J (where J is an integer equal to or more than 2 and smaller than I) FLK signals;

a data driving circuit configured to convert digital video data into data voltages to supply the data voltages for the data lines; and a gate driving circuit configured to generate gate pulses by level-shifting voltages of the gate shift clocks, to modulate falling edge voltages of the gate pulses in response to the divided FLK signals, and to sequentially supply the modulated gate pulses for the gate lines.

2. The display device of claim 1, wherein the gate shift clocks at least partially overlap each other, and wherein an N-th (where N is a positive integer) gate shift clock overlaps a latter part of a (N−1)-th gate shift clock by a predetermined time, and overlaps a former part of a (N+1)-th gate shift clock by a predetermined time.

3. The display device of claim 2, wherein a frequency of the single FLK signal is I times higher than a frequency of each of the gate shift clocks.

4. The display device of claim 3, wherein the gate shift clocks include first to sixth gate shift clocks which are sequentially delayed, and wherein the FLK dividing circuit comprises:

a first FLK dividing circuit configured to perform AND operation for the single FLK signal, the N-th gate shift clock, and a (N+2) gate shift clock, thereby generating first to sixth FLK signals; and a second FLK dividing circuit configured to perform OR operation for the first FLK signal and the fourth FLK signal to generate a I-th FLK signal, perform OR operation for the second FLK signal and the fifth FLK signal to generate a II-th FLK signal, and perform the third FLK signal and the sixth FLK signal to generate a III-th FLK signal.

5. The display device of claim 4, wherein the first to sixth FLK signals have the same phase difference as the gate shift clocks, and substantially have the same frequency as the gate shift clocks, and wherein a frequency of each of the I-th to III-th FLK signals is twice higher than a frequency of each of the first to sixth FLK signals.

6. The display device of claim 5, wherein the gate driving circuit comprises:

a first gate pulse modulation circuit configured to output a first gate pulse in response to the I-th FLK signal and the first gate shift clock, and reduce a voltage of the first gate pulse to a predetermined gate modulation high voltage between a falling edge of the I-th FLK signal and a falling edge of the first gate shift clock;

a second gate pulse modulation circuit configured to output a second gate pulse in response to the II-th FLK signal and the second gate shift clock, and reduce a voltage of the second gate pulse to the gate modulation high voltage between a falling edge of the II-th FLK signal and a falling edge of the second gate shift clock;

a third gate pulse modulation circuit configured to output a third gate pulse in response to the III-th FLK signal and the third gate shift clock, and reduce a voltage of the third gate pulse to the gate modulation high voltage between a falling edge of the III-th FLK signal and a falling edge of the third gate shift clock;

a fourth gate pulse modulation circuit configured to output a fourth gate pulse in response to the I-th FLK signal and the fourth gate shift clock, and reduce a voltage of the fourth gate pulse to the gate modulation high voltage between a falling edge of the I-th FLK signal and a falling edge of the fourth gate shift clock;

a fifth gate pulse modulation circuit configured to output a fifth gate pulse in response to the II-th FLK signal and the fifth gate shift clock, and reduce a voltage of the fifth gate pulse to the gate modulation high voltage between a falling edge of the II-th FLK signal and a falling edge of the fifth gate shift clock; and a sixth gate pulse modulation circuit configured to output a sixth gate pulse in response to the III-th FLK signal and the sixth gate shift clock, and reduce a voltage of the sixth gate pulse to the gate modulation high voltage between a falling edge of the III-th FLK signal and a falling edge of the sixth gate shift clock, wherein the gate pulses all vary between a gate high voltage and a gate low voltage and are sequentially delayed with the same phase difference as the gate shift clocks, and the gate modulation high voltage is higher than the gate low voltage and lower than the gate high voltage.

7. The display device of claim 3, wherein the gate shift clocks includes first to fourth gate shift clocks which are sequentially delayed, and wherein the FLK dividing circuit comprises:

a first FLK dividing circuit configured to perform AND operation for the single FLK signal, the N-th gate shift clock, and the (N+1) gate shift clock, thereby generating first to fourth FLK signals; and a second FLK dividing circuit configured to perform OR operation for the first FLK signal and the third FLK signal to generate a I-th FLK signal, and perform OR operation for the second FLK signal and the fourth FLK signal to generate a II-th FLK signal.

8. The display device of claim 7, wherein the first to fourth FLK signals have the same phase difference as the gate shift clocks, and substantially have the same frequency as the gate shift clocks, and wherein a frequency of each of the I-th and II-th FLK signals is twice higher than a frequency of each of the first to fourth FLK signals.

9. The display device of claim 8, wherein the gate driving circuit comprises:

a first gate pulse modulation circuit configured to output a first gate pulse in response to the I-th FLK signal and the first gate shift clock, and reduce a voltage of the first gate pulse to a predetermined gate modulation high voltage between a falling edge of the I-th FLK signal and a falling edge of the first gate shift clock;

a second gate pulse modulation circuit configured to output a second gate pulse in response to the II-th FLK signal and the second gate shift clock, and reduce a voltage of the second gate pulse to the gate modulation high voltage between a falling edge of the II-th FLK signal and a falling edge of the second gate shift clock;

a third gate pulse modulation circuit configured to output a third gate pulse in response to the III-th FLK signal and the third gate shift clock, and reduce a voltage of the third gate pulse to the gate modulation high voltage between a falling edge of the III-th FLK signal and a falling edge of the third gate shift clock; and a fourth gate pulse modulation circuit configured to output a fourth gate pulse in response to the II-th FLK signal and the fourth gate shift clock, and reduce a voltage of the fourth gate pulse to the gate modulation high voltage between a falling edge of the II-th FLK signal and a falling edge of the fourth gate shift clock, wherein the gate pulses all vary between a gate high voltage and a gate low voltage and are sequentially delayed with the same phase difference as the gate shift clocks, and the gate modulation high voltage is higher than the gate low voltage and lower than the gate high voltage.

10. The display device, wherein the display device is any one of a liquid crystal display (LCD), an organic light emitting diode (OLED) display, and an electrophoresis display (EPD).

11. A method for controlling a gate pulse modulation in a display device including a display panel in which data lines and gate lines cross each other, a timing controller configured to output a single gate pulse modulation control signal ("FLK signal") and I-phase (where I is an integer equal to or more than 2) gate shift clocks which are sequentially delayed, and a data driving circuit configured to convert digital video data into data voltages to supply the data voltages for the data lines, the method comprising:

dividing the single FLK signal to output J (where J is an integer equal to or more than 2 and smaller than I) FLK signals; and generating gate pulses by level-shifting voltages of the gate shift clocks, modulating falling edge voltages of the gate pulses in response to the divided FLK signals, and sequentially supplying the modulated gate pulses for the gate lines.

12. The method of claim 11, wherein the gate shift clocks at least partially overlap each other, and wherein an N-th (where N is a positive integer) gate shift clock overlaps a latter part of a (N−1)-th gate shift clock by a predetermined time, and overlaps a former part of a (N+1)-th gate shift clock by a predetermined time.

13. The method of claim 12, wherein a frequency of the single FLK signal is I times higher than a frequency of each of the gate shift clocks.

14. The method of claim 13, wherein the gate shift clocks include first to sixth gate shift clocks which are sequentially delayed, and wherein the step of diving of the single FLK signal comprises:

performing AND operation for the single FLK signal, the N-th gate shift clock, and a (N+2) gate shift clock, thereby generating first to sixth FLK signals; and performing OR operation for the first FLK signal and the fourth FLK signal to generate a I-th FLK signal, performing OR operation for the second FLK signal and the fifth FLK signal to generate a II-th FLK signal, and performing the third FLK signal and the sixth FLK signal to generate a III-th FLK signal.

15. The method of claim 14, wherein the first to sixth FLK signals have the same phase difference as the gate shift clocks, and substantially have the same frequency as the gate shift clocks, and wherein a frequency of each of the I-th to III-th FLK signals is twice higher than a frequency of each of the first to sixth FLK signals.

16. The method of claim 15, wherein the step of generating of the gate pulses comprises:

outputting a first gate pulse in response to the I-th FLK signal and the first gate shift clock, and reducing a voltage of the first gate pulse to a predetermined gate modulation high voltage between a falling edge of the I-th FLK signal and a falling edge of the first gate shift clock;

outputting a second gate pulse in response to the II-th FLK signal and the second gate shift clock, and reducing a voltage of the second gate pulse to the gate modulation high voltage between a falling edge of the II-th FLK signal and a falling edge of the second gate shift clock;

outputting a third gate pulse in response to the III-th FLK signal and the third gate shift clock, and reducing a voltage of the third gate pulse to the gate modulation high voltage between a falling edge of the III-th FLK signal and a falling edge of the third gate shift clock;

outputting a fourth gate pulse in response to the I-th FLK signal and the fourth gate shift clock, and reducing a voltage of the fourth gate pulse to the gate modulation high voltage between a falling edge of the I-th FLK signal and a falling edge of the fourth gate shift clock;

outputting a fifth gate pulse in response to the II-th FLK signal and the fifth gate shift clock, and reducing a voltage of the fifth gate pulse to the gate modulation high voltage between a falling edge of the II-th FLK signal and a falling edge of the fifth gate shift clock; and outputting a sixth gate pulse in response to the III-th FLK signal and the sixth gate shift clock, and reducing a voltage of the sixth gate pulse to the gate modulation high voltage between a falling edge of the III-th FLK signal and a falling edge of the sixth gate shift clock, wherein the gate pulses all vary between a gate high voltage and a gate low voltage and are sequentially delayed with the same phase difference as the gate shift clocks, and the gate modulation high voltage is higher than the gate low voltage and lower than the gate high voltage.

17. The method of claim 13, wherein the gate shift clocks includes first to fourth gate shift clocks which are sequentially delayed, and wherein the step of dividing of the single FLK signal comprises:

performing AND operation for the single FLK signal, the N-th gate shift clock, and the (N+1) gate shift clock, thereby generating first to fourth FLK signals; and performing OR operation for the first FLK signal and the third FLK signal to generate a I-th FLK signal, and performing OR operation for the second FLK signal and the fourth FLK signal to generate a II-th FLK signal.

18. The method of claim 17, wherein the first to fourth FLK signals have the same phase difference as the gate shift clocks, and substantially have the same frequency as the gate shift clocks, and wherein a frequency of each of the I-th and II-th FLK signals is twice higher than a frequency of each of the first to fourth FLK signals.

19. The method of claim 18, wherein the step of generating of the gate pulses comprises:

outputting a first gate pulse in response to the I-th FLK signal and the first gate shift clock, and reducing a voltage of the first gate pulse to a predetermined gate modulation high voltage between a falling edge of the I-th FLK signal and a falling edge of the first gate shift clock;

outputting a second gate pulse in response to the II-th FLK signal and the second gate shift clock, and reducing a voltage of the second gate pulse to the gate modulation high voltage between a falling edge of the II-th FLK signal and a falling edge of the second gate shift clock;

outputting a third gate pulse in response to the III-th FLK signal and the third gate shift clock, and reducing a voltage of the third gate pulse to the gate modulation high voltage between a falling edge of the III-th FLK signal and a falling edge of the third gate shift clock; and outputting a fourth gate pulse in response to the II-th FLK signal and the fourth gate shift clock, and reducing a voltage of the fourth gate pulse to the gate modulation high voltage between a falling edge of the II-th FLK signal and a falling edge of the fourth gate shift clock, wherein the gate pulses all vary between a gate high voltage and a gate low voltage and are sequentially delayed with the same phase difference as the gate shift clocks, and the gate modulation high voltage is higher than the gate low voltage and lower than the gate high voltage.

* * * * *